US005327652A

United States Patent [19]

Balback

[11] Patent Number: 5,327,652

[45] Date of Patent: Jul. 12, 1994

[54] HAND-HELD SEAM NOTCHING APPARATUS

[76] Inventor: Kellie A. Balback, 104 W. Monroe Ave., New Castle, Del. 19720

[21] Appl. No.: 96,301

[22] Filed: Jul. 26, 1993

[51] Int. Cl.[5] ..... B26F 1/36

[52] U.S. Cl. ..... 30/359; 30/229; 30/233; 30/364

[58] Field of Search ..... 30/229, 123, 359, 364, 30/233, 254

[56] References Cited

U.S. PATENT DOCUMENTS

| | | | |
|---|---|---|---|
| 415,836 | 11/1889 | Francis | 30/364 |
| 2,085,079 | 6/1937 | Broadwell | 30/229 |
| 2,224,226 | 12/1940 | Jensen | 30/229 |
| 2,595,841 | 5/1952 | Glick et al. | 30/229 |
| 2,751,681 | 6/1956 | Hillson | 30/229 |
| 3,372,482 | 3/1968 | Mercorelli | 30/229 |
| 4,106,195 | 8/1978 | Berg | 30/229 X |
| 4,255,857 | 3/1981 | Foley | 30/229 X |
| 4,689,884 | 9/1987 | Chararria | 30/229 |
| 4,729,170 | 3/1988 | Hartmeister | 30/229 X |
| 5,033,194 | 7/1991 | Long | 30/229 X |
| 5,067,242 | 11/1991 | Singer | 30/364 |

*Primary Examiner*—Rinaldi I. Rada
*Attorney, Agent, or Firm*—S. Michael Bender

[57] ABSTRACT

A new and improved hand-held seam notching apparatus includes two double-armed lever assemblies. A first double-armed lever assembly includes a first handle portion, a first fulcrum portion, and a first jaw portion. The first jaw portion includes a first well portion and a first cutter assembly received in the first well portion. The first jaw portion also includes a first connector for connecting the first cutter assembly to the first well portion. A second double-armed lever assembly includes a second handle portion, a second fulcrum portion, and a second jaw portion. The second jaw portion includes a second well portion and a second cutter assembly received in the second well portion. The second jaw portion also includes a second connector for connecting the second cutter assembly to the second well portion. A fulcrum member is pivotally connected to the first fulcrum portion and the second fulcrum portion, such that when the first handle portion and the second handle portion are moved together, the first jaw portion and the second jaw portion are moved together, and when the first handle portion and the second handle portion are moved apart, the first jaw portion and the second jaw portion are moved apart. A tracing wheel assembly may be connected to one of the jaw portions. A depth control assembly may be provided for controlling a distance from an edge of a fabric to notches made by the respective cutter assemblies.

8 Claims, 4 Drawing Sheets

HAND-HELD SEAM NOTCHING APPARATUS

BACKGROUND OF THE INVENTION

1. Field of the Invention

The present invention relates generally to devices for aiding in sewing, and, more particularly, to devices for aiding in notching seams in fabrics.

2. Description of the Prior Art

In the art of sewing, two pieces of fabric are often aligned, and a seam is sewn to keep the pieces of fabric together. When a seam is sown, it is desirable that the seam be in a straight line with respect to the edges of the pieces of fabric being sewn together. However, it is often difficult to maintain a straight seam while sewing.

To aid a person in sewing a seam in a predetermined pattern, the technique of placing notches in the fabric in a predetermined pattern has been developed. The following U.S. patent discloses a seam notching device: U.S. Pat. No. 4,930,219. This patent discloses a seam notching device which includes a notching member which includes a linear array of seven triangular notch makers. This device has several disadvantages. First, the linear array of notches permits only a straight line of notches. For actual sewing projects, a person sewing may wish to provide a seam that is not in a straight line, and the U.S. Pat. No. 4,930,219 would not be much help in this regard. In this respect, it would be desirable if a device for providing notches for sewing seams permitted setting out a non-linear pattern of notches.

Another deficiency with U.S. Pat. No. 4,930,219 is that each of the notches cut is a simple notch in a linear array of single notches. This pattern of notches coincides with a straight seam. There a many types of seams other than straight seams. For example, some seams are in a zig zag pattern. In this respect, it would be desirable if a device for providing notches for sewing seams set out a pattern of notches suitable for a zig zag seam.

As shown in U.S. Pat. No. 4,930,219, the notch cutters are present on a scissors device. A scissors device is useful for producing relatively small amounts of leverage and force multiplication to bring about notch cutting. The relatively small amounts of leverage may be adequate for cutting notches in thin fabric. However, the small amounts of leverage developed in a scissors device may be totally inadequate for cutting notches in a thick fabric. In this respect, it would be desirable if a device for providing notches in fabrics was capable of cutting notches in thick fabrics such as leather.

A hand-held tool that can generate large amounts and leverage and force multiplication is a pair of pliers. The following U.S. patents are representative of some devices using a pliers action: U.S. Pat. Nos. 4,476,633; 4,982,630; and 5,033,140. None of these devices disclose a hand-held pliers device for cutting notches in fabrics. In this respect, it would be desirable if a device were provided that employs a pliers action for cutting notches in fabrics.

Still other features would be desirable in a hand-held seam notching apparatus. There is a large variety of possible notch patterns that can be employed for a corresponding large variety of seam patterns. In this respect, it would be desirable if a notch cutting apparatus could be used for cutting a large variety of seam patterns.

In sewing operations, it is often desirable to trace a line onto fabric. In this respect, it would be desirable if a device for providing notches for sewing seams included a device for tracing in the fabric.

In sewing operations, it is often desirable if the person sewing could exercise steady control over the depth of the seam away from the edges of the respective fabrics being sewn together. In this respect, it would be desirable if a device for providing notches for sewing seams included a device for controlling depth of the seams from the edges of the fabrics to be sewn together.

Thus, while the foregoing body of prior art indicates it to be well known to use devices for cutting notches in fabrics, the prior art described above does not teach or suggest a hand-held seam notching apparatus which has the following combination of desirable features: (1) permits setting out a non-linear pattern of notches; (2) sets out a pattern of notches suitable for a zig zag seam; (3) is capable of cutting notches in thick fabrics such as leather; (4) employs a pliers action for cutting notches in fabrics; (5) can be used for cutting a large variety of seam patterns; (6) includes a device for tracing lines in the fabric; and (7) includes a device for controlling depth of the seams from the edges of the fabrics to be sewn together. The foregoing desired characteristics are provided by the unique hand-held seam notching apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved hand-held seam notching apparatus which includes two double-armed lever assemblies. A first double-armed lever assembly includes a first handle portion, a first fulcrum portion, and a first jaw portion. The first jaw portion includes a first well portion and a first cutter assembly received in the first well portion. The first jaw portion also includes a first connector for connecting the first cutter assembly to the first well portion. A second double-armed lever assembly includes a second handle portion, a second fulcrum portion, and a second jaw portion. The second jaw portion includes a second well portion and a second cutter assembly received in the second well portion. The second jaw portion also includes a second connector for connecting the second cutter assembly to the second well portion. A fulcrum member is pivotally connected to the first fulcrum portion and the second fulcrum portion, such that when the first handle portion and the second handle portion are moved together, the first jaw portion and the second jaw portion are moved together, and when the first handle portion and the second handle portion are moved apart, the first jaw portion and the second jaw portion are moved apart.

The first well portion may include first guide portions, and the first cutter assembly may include second guide portions. The first guide portions are complementary to the second guide portions for guiding orientation of the first cutter assembly in the first well portion. The second well portion may include third guide portions, and the second cutter assembly may include fourth guide portions. The third guide portions are complementary to the fourth guide portions for guiding orientation of the second cutter assembly in the second well portion.

A spring contacts the first handle portion and the second handle portion for urging the first handle portion and the second handle portion apart, whereby the first jaw portion and the second jaw portion are urged apart. The spring may be supported by the fulcrum member. When the first handle portion and the second handle portion are squeezed together, the tension of the spring is overcome, and the notches are made in the fabric. After the notches are made in the fabric, the squeezing tension on the respective handle portions is released, and the spring once again urges the handle portions and the jaw portions apart.

A tracing wheel assembly may be connected to one of the jaw portions. The tracing wheel assembly may include a tracing wheel connected to a jaw portion by a connector. The connector permits rotation of the tracing wheel. A wheel guard may be connected to the jaw portion for selectively guarding and exposing the tracing wheel, such that the tracing wheel can be used for tracing on a pattern on a fabric when desired. The wheel guard is attached to the jaw portion by a pivot connection.

A depth control assembly may be provided for controlling a distance from an edge of a fabric to notches made by the respective cutter assemblies. The depth control assembly includes a locking bolt inserted in an aperture in the second jaw portion. A lock nut connects the locking bolt. A guide element includes a portion located between the second jaw portion and the lock nut. The guide element also includes a slot through which the locking bolt passes. The guide element also includes an extension portion which extends away from the second jaw portion toward the fabric. The guide element also includes indicia located on the extension portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved hand-held seam notching apparatus which has all of the advantages of the prior art and none of the disadvantages.

It is another object of the present invention to provide a new and improved hand-held seam notching apparatus which may be easily and efficiently manufactured and marketed.

It is a further object of the present invention to provide a new and improved hand-held seam notching apparatus which is of durable and reliable construction.

An even further object of the present invention is to provide a new and improved hand-held seam notching apparatus which is susceptible of a low cost of manufacture with regard to both materials and labor, and which accordingly is then susceptible of low prices of sale to the consuming public, thereby making such hand-held seam notching apparatus available to the buying public.

Still yet a further object of the present invention is to provide a new and improved hand-held seam notching apparatus which permits setting out a non-linear pattern of notches.

Still another object of the present invention is to provide a new and improved hand-held seam notching apparatus that sets out a pattern of notches suitable for a zig zag seam.

Yet another object of the present invention is to provide a new and improved hand-held seam notching apparatus which is capable of cutting notches in thick fabrics such as leather.

Even another object of the present invention is to provide a new and improved hand-held seam notching apparatus that employs a pliers action for cutting notches in fabrics.

Still a further object of the present invention is to provide a new and improved hand-held seam notching apparatus which can be used for cutting a large variety of seam patterns.

Yet another object of the present invention is to provide a new and improved hand-held seam notching apparatus that includes a device for tracing lines in the fabric.

Still another object of the present invention is to provide a new and improved hand-held seam notching apparatus which includes a device for controlling depth of the seams from the edges of the fabrics to be sewn together.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
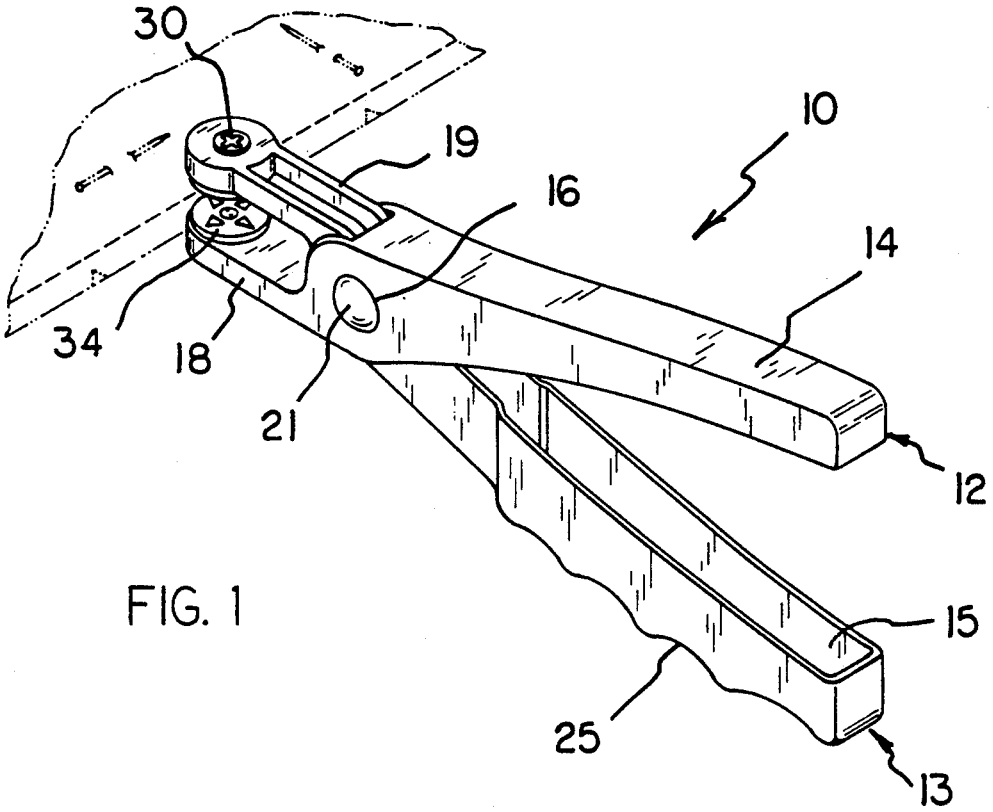
FIG. 1 is a perspective view showing a first preferred embodiment of the hand-held seam notching apparatus of the invention.
Figure 2:
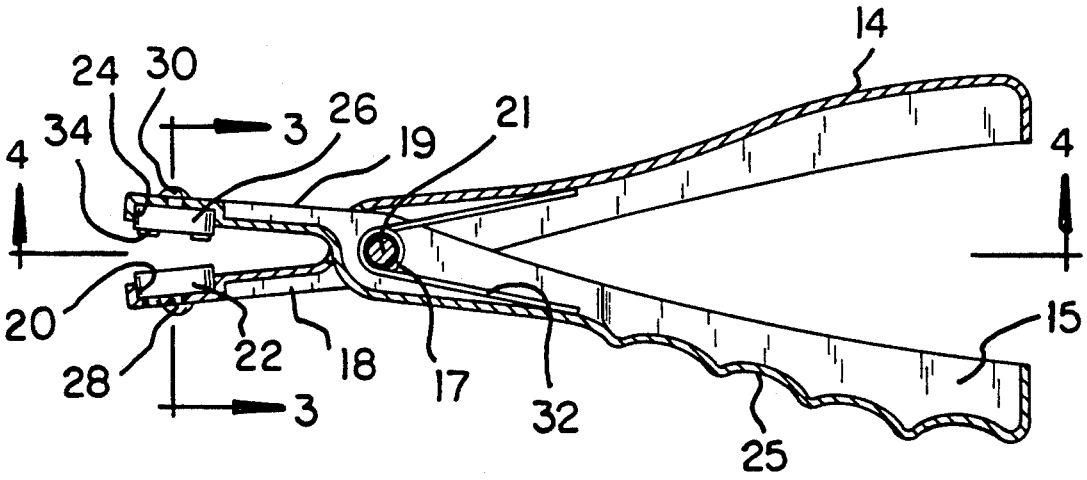
FIG. 2 is a side view of the hand-held seam notching apparatus shown in FIG. 1.
Figure 3:
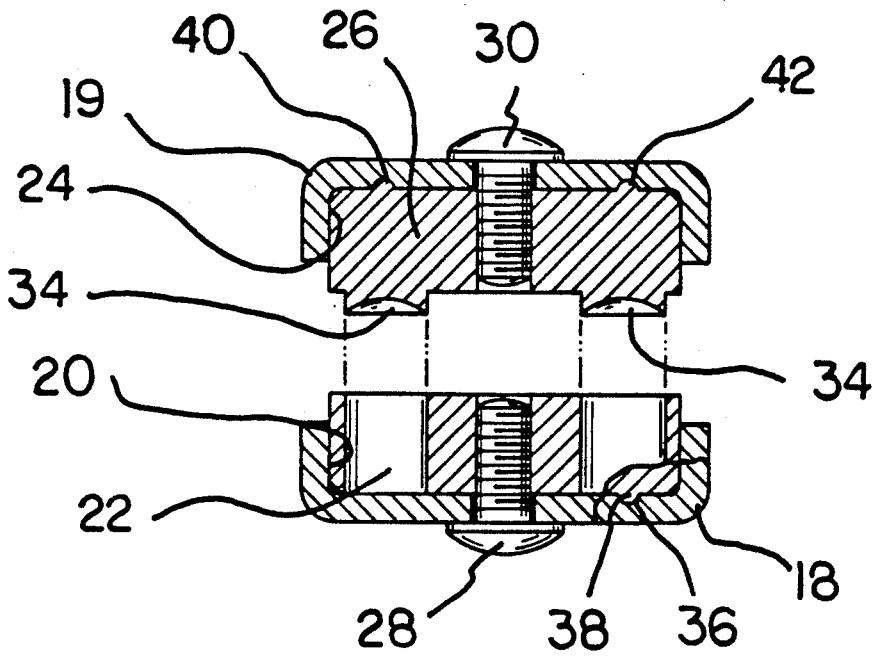
FIG. 3 is an enlarged front view of the hand-held seam notching apparatus of FIG. 2 taken along line 3—3 thereof.
Figure 4:
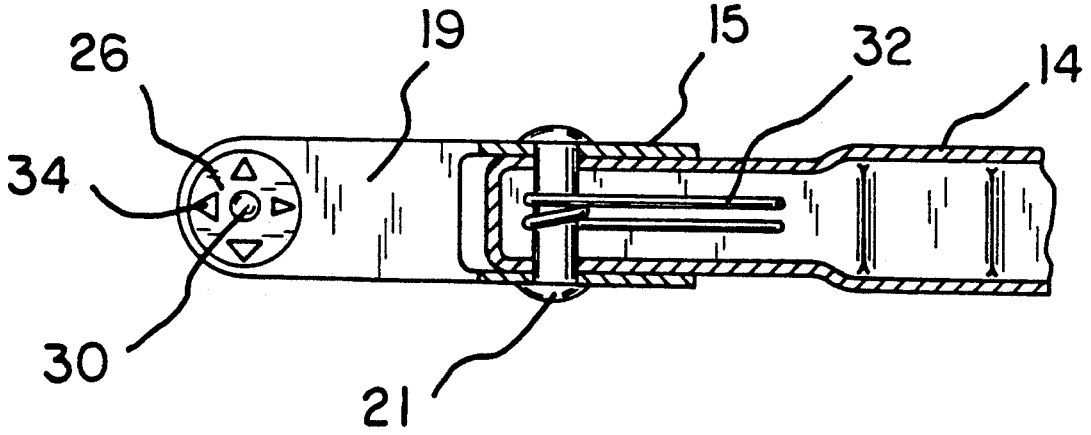
FIG. 4 is a cross-sectional view of the embodiment of the invention shown in FIG. 2 taken along the line 4—4 of FIG. 2.

With reference to the drawings, a new and improved hand-held seam notching apparatus embodying the principles and concepts of the present invention will be described.

Turning initially to FIGS. 1–4, there is shown a first exemplary embodiment of the hand-held seam notching apparatus of the invention generally designated by reference numeral 10. In its preferred form, hand-held seam notching apparatus 10 includes two double-armed lever assemblies 12 and 13. A first double-armed lever assembly 12 includes a first handle portion 14, a first fulcrum portion 16, and a first jaw portion 18. The first jaw portion 18 includes a first well portion 20 and a first cutter assembly 22 received in the first well portion 20. The first jaw portion 18 also includes a first connector 28 for connecting the first cutter assembly 22 to the first well portion 20. A second double-armed lever assembly 13 includes a second handle portion 15, a second fulcrum portion 17, and a second jaw portion 19. The second jaw portion 19 includes a second well portion 24 and a second cutter assembly 26 received in the second well portion 24. The second jaw portion 19 also includes a second connector 30 for connecting the second cutter assembly 26 to the second well portion 24. A finger grip portion 25 is also provided on the second handle portion 15.

A fulcrum member 21 is pivotally connected to the first fulcrum portion 16 and the second fulcrum portion 17, such that when the first handle portion 14 and the second handle portion 15 are moved together, the first jaw portion 18 and the second jaw portion 19 are moved together, and when the first handle portion 14 and the second handle portion 15 are moved apart, the first jaw portion 18 and the second jaw portion 19 are moved apart.

The first cutter assembly 22 and the second cutter assembly 26 can include a variety of patterns of cutting elements 34. The cutting elements 34 can be in a variety of forms and arrayed in a variety of patterns in the respective first cutter assembly 22 and the respective second cutter assembly 26.

The first cutter assembly 22 includes a threaded portion for connecting with a complementary threaded first connector 28. The second cutter assembly 26 includes a threaded portion for connecting with a complementary threaded portion on second connector 30. With this arrangement, it is easy to remove and replace respective cutter assemblies from their respective wells and replace the cutter assemblies with other cutter assemblies.

The first well portion 20 includes first guide portions 36, and the first cutter assembly 22 includes second guide portions 38. The first guide portions 36 are complementary to the second guide portions 38 for guiding orientation of the first cutter assembly 22 in the first well portion 20. The second well portion 24 includes third guide portions 40, and the second cutter assembly 26 includes fourth guide portions 42. The third guide portions 40 are complementary to the fourth guide portions 42 for guiding orientation of the second cutter assembly 26 in the second well portion 24.

A spring 32 contacts the first handle portion 14 and the second handle portion 15 for urging the first handle portion 14 and the second handle portion 15 apart, whereby the first jaw portion 18 and the second jaw portion 19 are urged apart. The spring 32 is supported by the fulcrum member 21. When the first handle portion 14 and the second handle portion 15 are squeezed together, the tension of the spring 32 is overcome, and the notches are made in the fabric. After the notches are made in the fabric, the squeezing tension on the respective handle portions is released, and the spring 32 once again urges the handle portions and the jaw portions apart.

Figure 5:
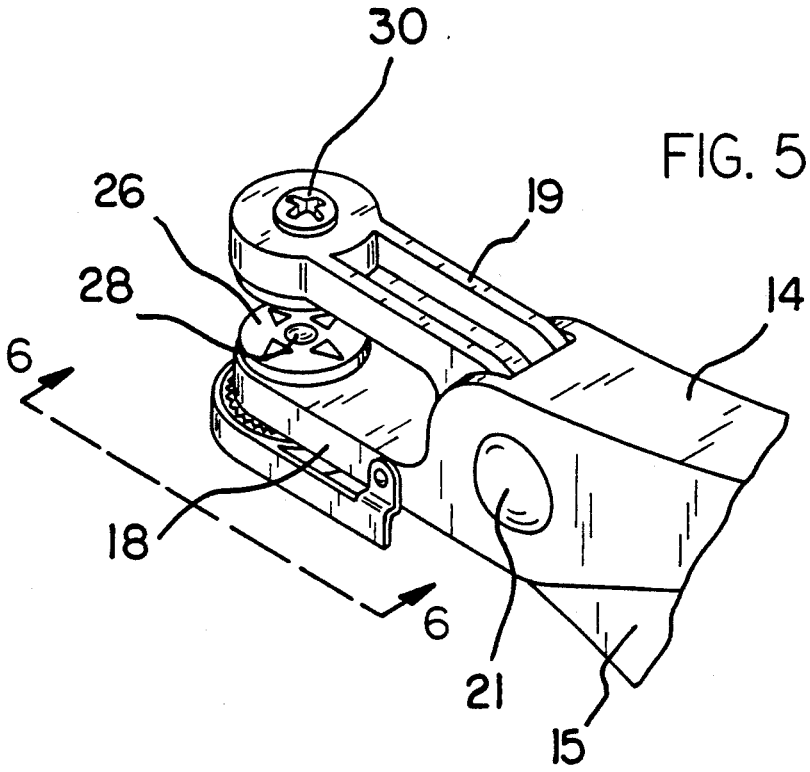
FIG. 5 is a partial perspective view of a second preferred embodiment of the invention which includes a device for tracing lines.
Figure 6:
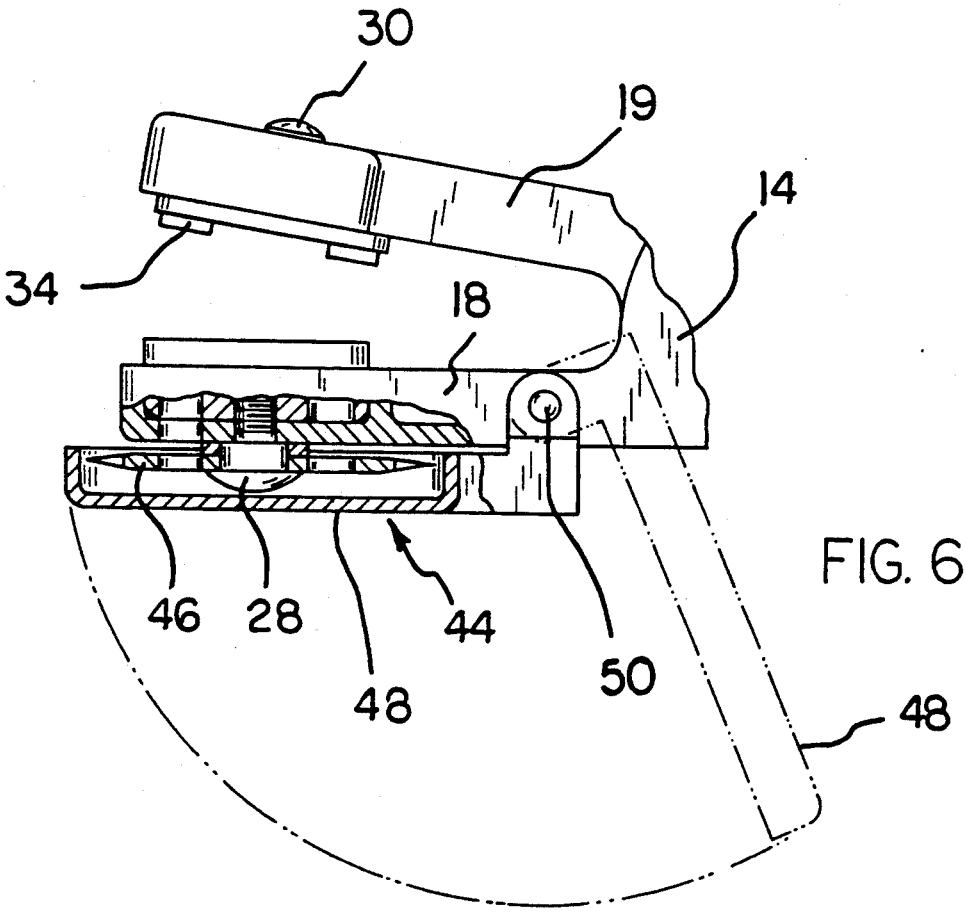
FIG. 6 is an enlarged side view, partially broken away, of the embodiment of the invention shown in FIG. 5 taken along line 6—6 in FIG. 5.

Turning to FIGS. 5–6, a second embodiment of the invention is shown. Reference numerals are shown that correspond to like reference numerals that designate like elements shown in the other figures. In addition, a tracing wheel assembly 44 is connected to one of the jaw portions. The tracing wheel assembly 44 includes a tracing wheel 46 connected to a jaw portion by a connector. The connector permits rotation of the tracing wheel 46. A wheel guard 48 is connected to the jaw portion for selectively guarding and exposing the tracing wheel 46, such that the tracing wheel 46 can be used for tracing on a pattern on a fabric when desired. The wheel guard 48 is attached to the jaw portion by a pivot connection 50. In FIG. 6, the wheel guard 48 is shown in position guarding the tracing wheel 46. Also, in FIG. 6, a dotted outline shows the wheel guard 48 moved out of a guarding position to expose the tracing wheel 46 to enable tracing.

Figure 7:
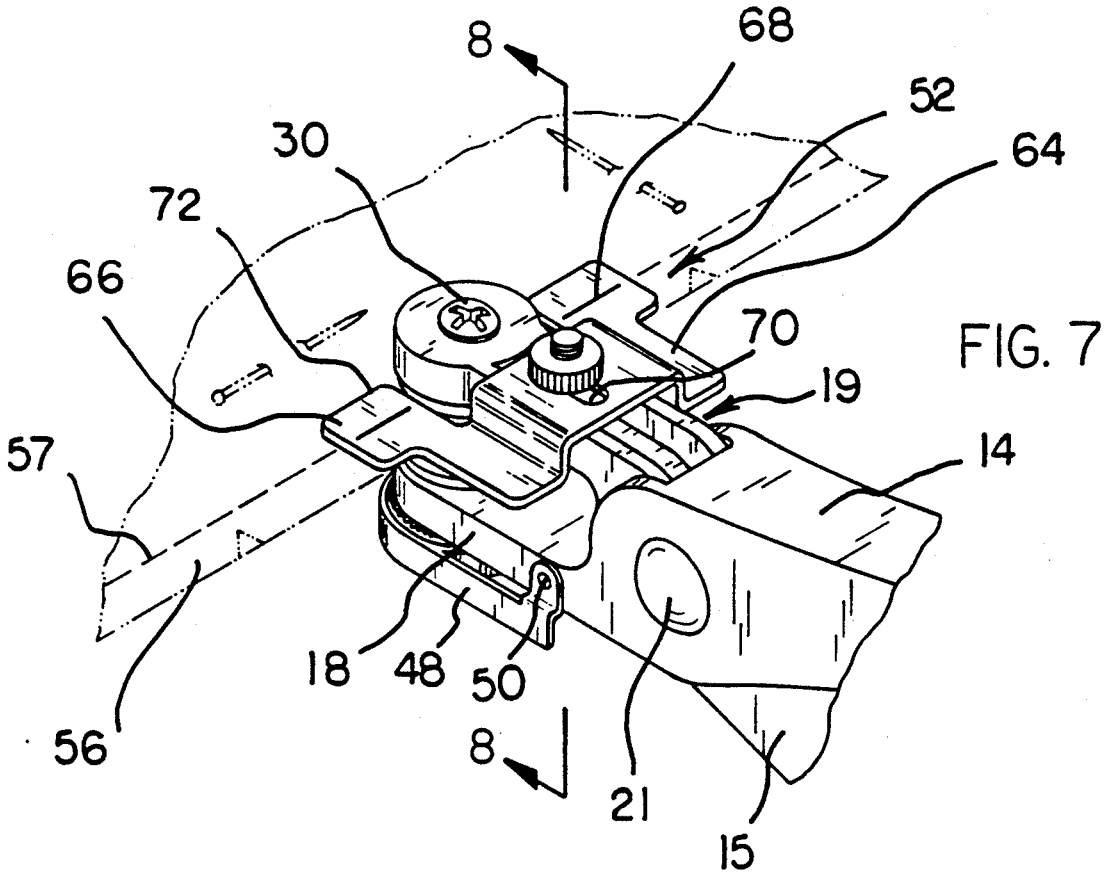
FIG. 7 is a partial perspective view of a third embodiment of the invention which includes a device for spacing the notches a predetermined distance from the respective edges of the fabrics to be sewn.
Figure 8:
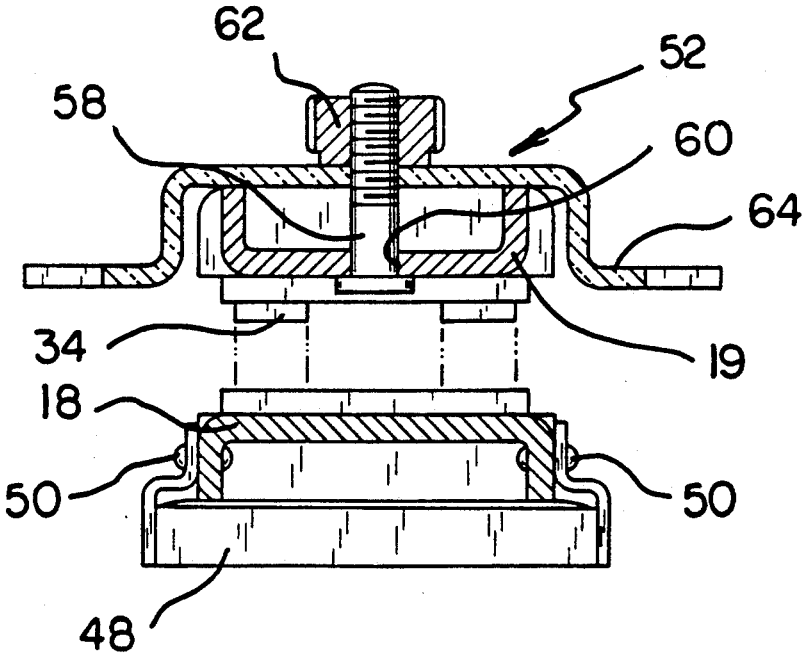
FIG. 8 is an enlarged cross-sectional view of the embodiment of the invention shown in FIG. 7 taken along line 8—8 of FIG. 7.

Turning to FIGS. 7–8, a third embodiment of the invention is shown. Reference numerals are shown that correspond to like reference numerals that designate like elements shown in the other figures. In addition, a depth control assembly 52 is provided for controlling a distance from an edge of a fabric 56 to notches made by the respective cutter assemblies. The depth control assembly 52 includes a locking bolt 58 inserted in an aperture 60 in the second jaw portion 19. A lock nut 62 connects the locking bolt 58. A guide element 64 includes a portion located between the second jaw portion 19 and the lock nut 62. The guide element 64 also includes a slot 70 through which the locking bolt 58 passes. The guide element 64 also includes an extension portion 66 which extends away from the second jaw portion 19 toward the fabric 56. The guide element 64 also includes indicia 68 located on the extension portion 66.

By loosening the lock nut 62, the guide element 64 can be moved closer to or farther away from the fabric 56 by sliding the guide element 64 along the slot 70 in either direction. A predetermined distance between the edge of the fabric 56 and the cutting elements 34 is determined by reference to the indicia 68 which can be aligned with an edge 57 of the fabric 56. After the predetermined distance is set, the lock nut 62 is retightened.

The components of the hand-held seam notching apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved hand-held seam notching apparatus that is low in cost, relatively simple in design and operation, and which may advantageously be used to permit setting out a non-linear pattern of notches. With the invention, a hand-held seam notching apparatus is provided which sets out a pattern of notches suitable for a zig zag seam. With the invention, a hand-held seam notching apparatus is provided which is capable of cutting notches in thick fabrics such as leather. With the invention, a hand-held seam notching apparatus is provided which employs a pliers action for cutting notches in fabrics. With the invention, a hand-held seam notching apparatus is provided which can be used for cutting a large variety of seam patterns. With the invention, a hand-held seam notching apparatus is provided which includes a device for tracing lines in the fabric. With the invention, a hand-held seam notching apparatus is provided which includes a device for controlling depth of the seams from the edges of the fabrics to be sewn together.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A doubled-armed lever hand-held seam notching apparatus, comprising:

a first arm lever assembly which includes a first handle portion, a first fulcrum portion, and a first jaw portion, said first jaw portion including a first well portion and a first cutter assembly received in said first well portion, said first jaw portion also including a first connector for connecting said first cutter assembly to said first well portion, a second arm lever assembly which includes a second handle portion, a second fulcrum portion, and a second jaw portion, said second jaw portion including a second well portion and a second cutter assembly received in said second well portion, said second jaw portion also including a second connector for connecting said second cutter assembly to said second well portion, and a fulcrum member pivotally connected to said first fulcrum portion and said second fulcrum portion, such that when said first handle portion and said second handle portion are moved together, said first jaw portion and said second jaw portion are moved together, and such that, when said first handle portion and said second handle portion are moved apart, said first jaw portion and said second jaw portion are moved apart, wherein:

said at least said first well portion includes first guide portions, at least said first cutter assembly includes second guide portions, said first guide portions being complementary to said second guide portions for guiding orientation of said first cutter assembly in said first well portion, wherein said at least first well portion defines a first cylindrical recess and said at least first cutter assembly comprises a first cylindrical disk adapted to seated in said first cylindrical recess in a selected angular orientation relative to each other.

2. The apparatus described in claim 1 wherein:

said second well portion includes third guide portions, and said second cutter assembly includes fourth guide portions, said third guide portions being complementary to said fourth guide portions for guiding orientation of said second cutter assembly in said second well portion, and wherein said second well portion defines a second cylindrical recess and said second cutter assembly comprises a second cylindrical disk adapted be seated in said second cylindrical recess in a selected angular orientation relative to each other.

3. The apparatus described in claim 1, further including:

a spring contacting said first handle portion and said second handle portion for urging said first handle portion and said second handle portion apart, whereby said first jaw portion and said second jaw portion are urged apart.

4. The apparatus described in claim 1, further including:

a tracing wheel assembly connected to one of said jaw portions.

5. The apparatus described in claim 4 wherein said tracing wheel assembly includes:

a tracing wheel connected to a jaw portion by a connector, said connector permitting rotation of said tracing wheel, and a wheel guard, connected to said jaw portion, for selectively guarding and exposing said tracing wheel, such that said tracing wheel can be used for tracing.

6. The apparatus described in claim 5 wherein said wheel guard is attached to said jaw portion by a pivot connection.

7. The apparatus described in claim 1, further including:

a depth control assembly for controlling a distance from an edge of a fabric to notches made by said respective cutter assemblies.

8. The apparatus described in claim 7 wherein said depth control assembly includes:

a locking bolt inserted in an aperture in said second jaw portion, a lock nut for connection to said locking bolt, and a guide element including a portion located between said second jaw portion and said lock nut, said guide element also including a slot through which said locking bolt passes, said guide element also including an extension portion which extends away from said second jaw portion toward the fabric, said guide element also including indicia located on said extension portion.

* * * * *